United States Patent [19]

Glock et al.

[11] 4,070,050

[45] Jan. 24, 1978

[54] HOLDER FOR ANCHORING THE TRUNK LID OF A CAR

[76] Inventors: Wilfried Glock; Josef Ruppert; Jorg Korecki, all of Liebenzeller Strasse 11/1, 7032 Sindelfingen, Germany

[21] Appl. No.: 739,061

[22] Filed: Nov. 5, 1976

[30] Foreign Application Priority Data

Sept. 28, 1976 Germany ..... 2643694

[51] Int. Cl.[2] ..... E05C 17/30

[52] U.S. Cl. ..... 292/339; 292/DIG. 29

[58] Field of Search ..... 292/262, 258, 288, 338, 292/278, DIG. 29, 339

[56] References Cited

U.S. PATENT DOCUMENTS

| | | | |
|---|---|---|---|
| 2,462,174 | 2/1949 | Fisher | 16/86 A |
| 3,180,668 | 4/1965 | Brown | 292/288 X |
| 3,971,589 | 7/1976 | Elrod | 292/262 X |

*Primary Examiner*—Richard E. Moore

[57] ABSTRACT

A bracing bar comprises a solid bar telescopically inserted in a tube and anchored by a lock screw to set the length of the bracing bar. One end of the bracing bar has a coil spring and a male locking member secured thereto which can be connected to a first half of a trunk lock and the other end has a female locking member which can be connected to a second half of a trunk lock.

14 Claims, 5 Drawing Figures

Figure 1:
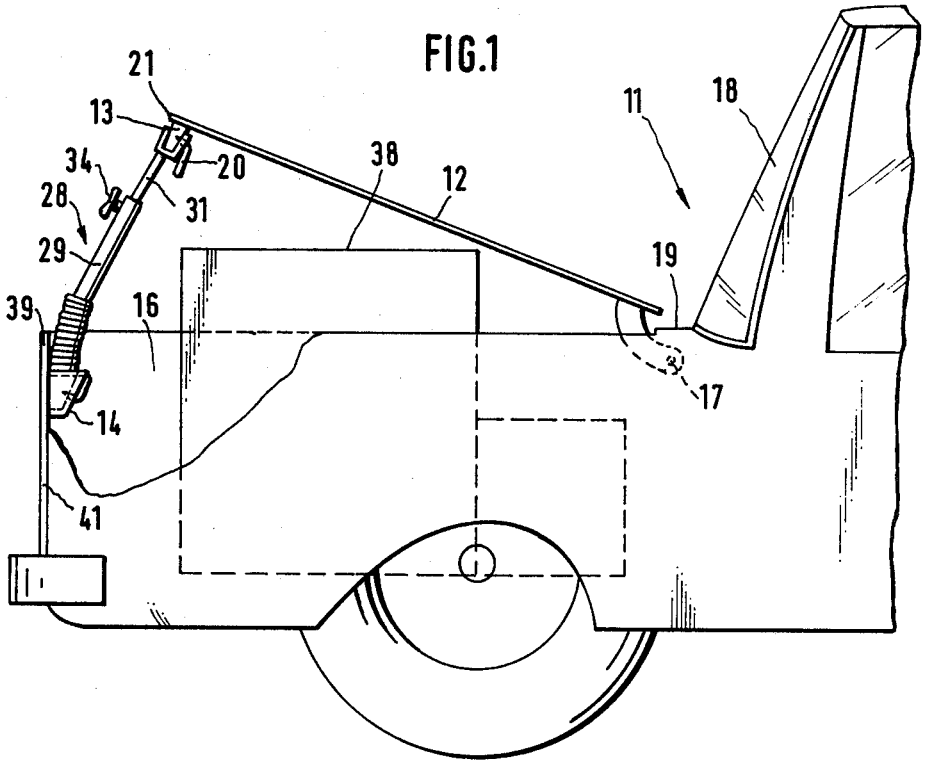

21
13
34
28
29
39
20
31
38
12
11
18
19
16
17
14
41

HOLDER FOR ANCHORING THE TRUNK LID OF A CAR

The invention relates to a holder for anchoring the trunk lid of a car in a predetermined open position, the trunk being closable by means of a standard-type trunk lock comprising a first half and a second half which can snap-lock therein, the second half of the lock being arranged on the trunk lid and the first half on the trunk wall rigidly fixed to the car body.

To maintain the trunk lid in its upper and most widely open pivot position, most standard-type cars are provided with a spring tensioning device which from a central pivot position overcompensates for the weight of the trunk lid, moves it automatically into its upper pivoted position and holds it in said position. Below its dead centre, the spring tensioning device draws the lid downward.

Reliable anchoring of the trunk lid in its top or bottom pivoted end position cannot be achieved by this spring tensioner alone. If the trunk lid has to be kept slightly open because it is necessary to transport bulky articles which are somewhat higher than the maximum or clear height of the trunk and/or longer than same so that they protrude out of the rear of the trunk, the trunk lid must be somehow fixed in the lowest possible pivot position in order that it firstly does not obstruct the driver's rear view and secondly cannot strike against and damage the transported articles during travel or cannot itself be damaged as a result. If the trunk lid is maintained in contact with the transported article by means of a cord or a rubber tensioner, it can no longer swing upward, but may continue to strike down against and damage the transported article as a result of bumps during travel. Moreover, cords or ropes may chafe during travel so that the trunk lid may spring up and obstruct the view to the rear. The condition of the cord must therefore be checked regularly. If a cord or rope fastening exerts too much pull or tension, the lid which is usually not very robust in design may also become warped and the trunk then no longer reliably locked.

The problem for the invention is therefore to provide a holder of the type mentioned at the beginning of the specification which enables the trunk lid to be reliably anchored in a desired open position so that it cannot swing up or down, can be mounted very easily by hand, occupies little space and is so cheap to manufacture that it is beneficial to purchase one even if it is used extremely infrequently.

This problem is solved in accordance with the invention by providing a bracing or supporting bar which can be adjusted with respect to its length to suit the desired opening of the trunk lid, one end of the said bracing bar bearing a first member of a pair, which can be positively connected to the first half of the trunk lock, and its other end bearing a second member of a pair to which the second half of the trunk lock can be connected, the said bracing bar having a flexibility which permits positive interlocking of the two lock halves and/or being articulated is design.

The holder according to the invention has at least the following advantages:

1. By using the bracing bar with a variable effective length which engages on and is secured to the lock sections of the trunk lid and trunk wall, it is possible to prevent the lid from executing undesirable upward or downward movements so that it can be fixed at a short clear distance from the bulky objects to be transported, so that both they and the trunk lid are optimally protected.

2. The fastening of the brace by connecting its two cooperating elements to both halves of the trunk lock can be effected very simply by hand and in a few seconds. The fastening is then just as secure as the locking of the lock.

3. Despite its robust design, the holder occupies only a little space and can be conveniently carried in an already existing recess in the trunk, at least in its setting corresponding to the minimum opening of the trunk, and also fitted easily in a recess or compartment provided for the spare wheel so that it causes no obstructive or inconvenience at all.

In cases where the connections at the ends of the brace to the two halves of the trunk lock would themselves alone allow a pivoting movement in the pivot plane of the trunk lid containing the brace, it is possible for the brace to be completely rigid in design and for the ends of the pair of cooperating elements to be also rigidly connected to the brace.

However, in cases where one cooperating element of the brace of both create a connection, precisely positive and practically free of play in all directions, with the associated part of the lock, the bracing bar must be flexible at least in sections or pivotally designed with a limited pivoting range in order that the cooperating elements can also be connected to the complementary halves of the trunk lock, with the trunk lid in different pivot positions.

Said first cooperating member is a standard-type male element and said second cooperating member a standard-type female element. These features enable extremely cheap manufacture of the holder since the male and female elements are moreover mass-produced parts.

Said bracing bar comprises a tube section, which is connected to one of said cooperating members by said flexible means which comprises a flexible connecting piece, a bar section telescopically removably inserted in said tube section, and a locking screw for anchoring said bracing bar in a drawnout position, the other of said cooperating members being connected on the free end of said bar. A particularly simple embodiment of the holder is in this case disclosed by these features. Through the flexible connecting piece between one part of the lock and the telescopic tube of the brace, the only slightly varying directions of insertion of the brace lock halves into the cooperating elements of the trunk lock, with the trunk lid at different opening angles, may be easily compensated for.

Said flexible connecting piece is in the form of a spiral tension spring which encircles one end of said tube section at one of its ends, one of said cooperating members being welded to its other end. A connection, which is flexible and elastically extensible in all directions, between the bracing tube and one half of the lock is obtained by these features. This is achieved because the trunk lid can be drawn towards a bulky article to be transported with also a certain pretensioning, which is quite desirable in some cases. Moreover, a spiral spring is easily flexible in all directions so that the brace can still be connected to the halves of the lock even when the latter are no longer in precise alignment as a result of damage. In the very case where the trunk can no longer be closed owing to damage after an accident, it is particularly advantageous if the lid can be secured in a suitable position with the aid of the holder.

Said spiral spring is arranged on the end of said bracing bar bearing the cooperating member which can engage with the first lock half of the trunk lock which is rigidly fixed to the car body. A particularly advantageous embodiment for the convenient manipulation of the holder is achieved through these features.

Said bracing bar comprises at least two supporting members rigidly connected to select the length of said bracing bar, and wherein male and female elements are each connected to the ends of said bracing bar and are interconnected through a flexible connection having a pivot axis of the trunk lid. A precisely positive connection between the holder and trunk lock even when the brace is absolutely rigid is made possible through these features.

Means are provided for locking the holder in a setting corresponding to the desired opening angle of the trunk lid. The advantage which is immediately obvious from these features is that at least bulky articles are secured against unauthorized removal thereof from the trunk.

In a number of motors cars the female portion of the trunk lock consists of a disc or plate which is rotatably mounted on the lid and provided with an open-edged, curved and/or angular solt-shaped recess; the male portion rigidly connected to the car body consists of a rod or shackle section running parallel to the axis of rotation of the female element, for example the yoke or cross piece of a U-shaped freely upwardly projecting coupling which is attached to the rear wall of the trunk and moves into the recess of the female element when the trunk lid is closed. During closing of the lid the female element then rotates until the bottom edge of its recess engages positively on the rear of the male element, in which position the female element is locked by means of a locking device.

With these locks the female element and catch mechanism are usually net combined to form a standard-type unit which could be welded to the bar or the spiral spring of the holder in the previously described manner or secured in any other suitable manner.

For a motor car having a trunk lock with a male element in the form of a U-shaped section, the a female element in the form of a rotatably mounted disc having an open-edged, slot-shaped recess in which the U-section engages when the trunk lid is closed upon rotation of the disc, at least one edge section of the recess engaging positively on the rear of the U-section, in which position the disc can be locked by means of a catch mechanism or the like, wherein the cooperating member at the end of the holder to be connected to the U-section comprises a hook which can be suspended from the U-section and is provided with retaining means which can be adjusted to suit U-sections of varying thicknesses and which maintains said hook in a position of engagement in the U-section, and wherein the cooperating member at the other end of the holder has a cross section which is adapted to the narrowest width of recess in the female element used. Through these features it is also possible to provide these vehicles with a holder which can be coupled to the male and female elements of the trunk lock, manufactured reasonably cheaply and is suitable for a great number of different types of locks with a rotatable female element.

A standard U-section of the trunk lock having the smallest material cross section is used as a male cooperating member of the holder. A type of male element on the holder which can be used on practically all standard-type vehicles is obtained by these features.

Said cooperating member at the other end of the holder comprises an end section bent at right angles to the longitudinal axis of the holder on a telescopically removable bar in a tube section, the free end of said end section being provided with a flange having a diameter greater than the width of the recess in the disc. These features disclose a particularly simple to make version of the male element which in price terms has advantages over the standard-type male elements in use.

Said retaining means comprises a knurled nut which is guided along a threaded section of said hook and is provided with a rubber lining on its side directed towards said hook. A version of the female element of the holder which can be adapted to male elements of greatly varying thickness is obtained by these features in which case the rubber layer on the lock nut also prevents, through an elastic/positive connection with the male element against which it is pressed, the said nut from working loose as a result of vibrations occurring during transportation.

Said threaded section of said hook is screwed into a tapped hole in a threaded piece attached to said flexible means comprising a spiral spring on said bracing bar, said tapped hole being coaxial with said spiral spring. A particularly simple and adjustable fastening of the hook to the holder is achieved with these features. Also, a screw-in hook can if necessary be exchanged for a much wider or narrow hook so that the holder can also be adapted to the extremely varying dimensions of the male element of the trunk lock.

Said threaded piece has an external thread with approximately the same pitch and effective diameter as the internal thread formed by the coils of said spiral spring. A rigid connection between the threaded portion or the hook and the spiral spring is obtained through these features without the elastic properties of the latter being adversely affected by a welded joint. Moreover, the holder can have additional length adjustability. In this connection it can also be advantageous if the effective diameter and/or the pitch of the external thread of the threaded portion is slightly greater than the effective internal diameter or pitch of the spiral spring in order that the coils of the spiral spring may engage, under a certain degree- of pretensioning, on the screwed-in threaded portion so that the latter does not rotate relative to the spiral spring when the normal vibrations in traffic occur.

Figure 2:
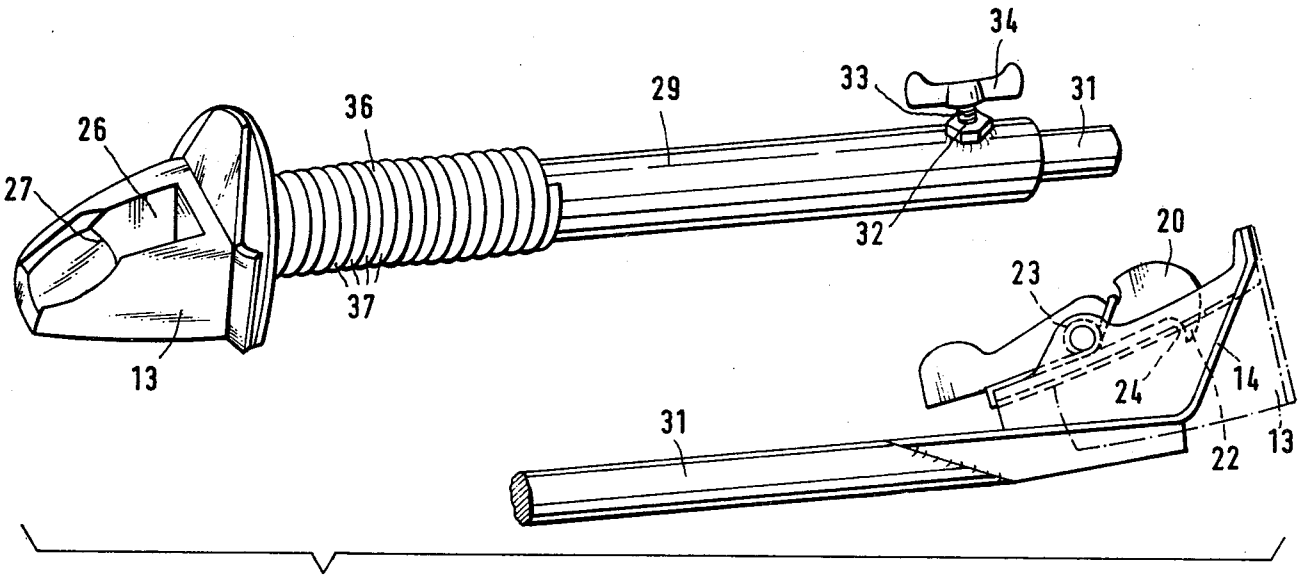
Figure 3:
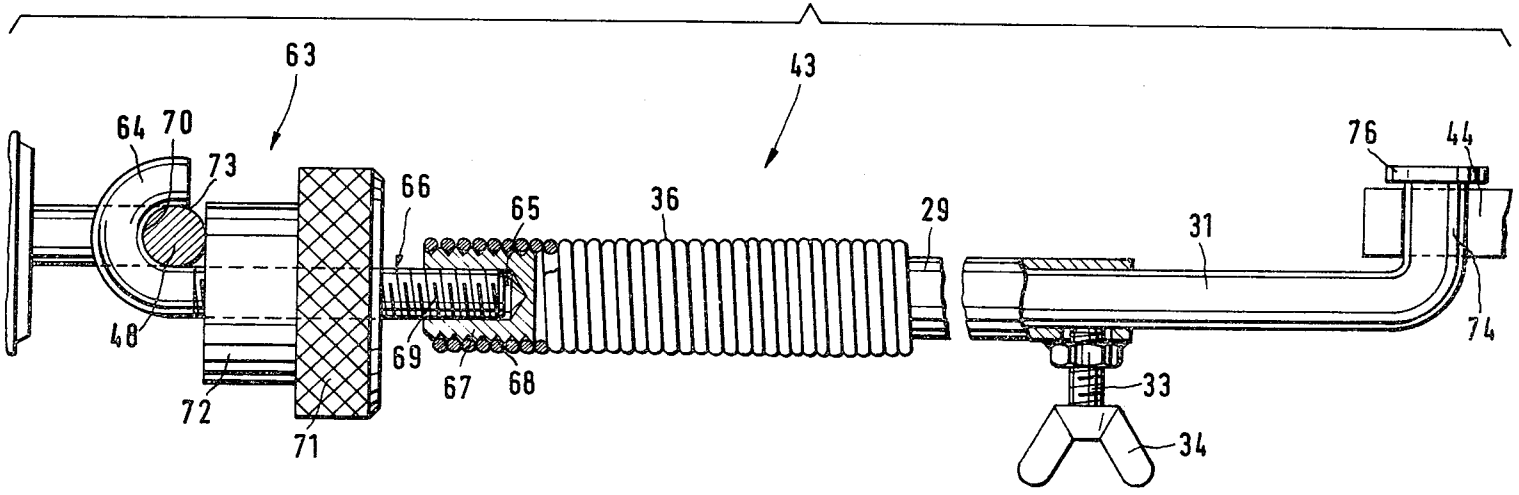
Figure 4:
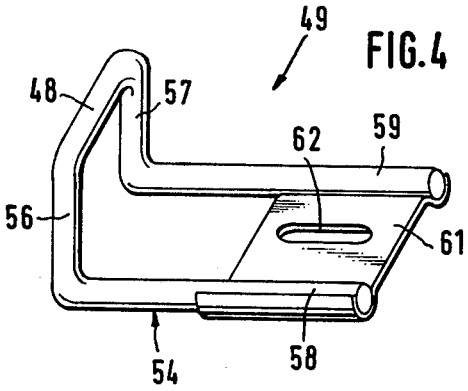
Figure 5:
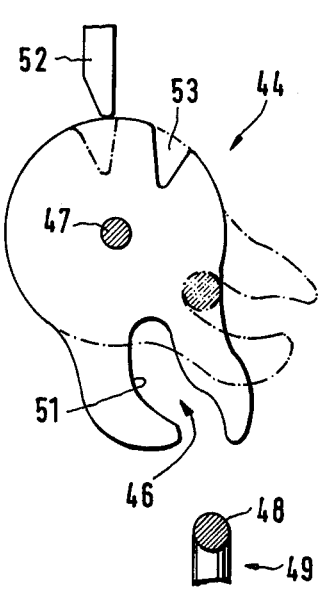

Further details and features of the invention are evident from the following description of a practical embodiment with the aid of the drawings:

FIG. 1 is a fragmentary, diagrammatic side elevation of a motor car, the trunk lid of which is anchored in a predetermined open position by means of the holder according to the invention, FIG. 2 shows details of the holder according to FIG. 1, FIG. 3 shows a second embodiment of the holder according to the invention, FIG. 4 shows details of a male element suitable for use in combination with the holder shown in FIG. 3, and FIG. 5 shows details of a female element of the trunk lock suitable for coupling to the holder according to FIG. 3.

A motor car 11 comprises a trunk 16 which can be covered with a trunk lid 12 and closed by means of a tightly locking snap lock 13, 14. The lid 12 is pivotable about a horizontal axle 17 which extends just below the bottom edge of the rear window 18 and under the vehicle skin 19. A spring tensioner (not shown) is capable of maintaining the lid 12 in its upper pivoting position in which it occupies almost the entire field of vision which can be covered with the rearview mirror.

In a central pivoting position the weight of the lid 12 is directly compensated for or balanced by the spring tensioner so that a gently exerted upward or downward pressure is sufficient for the trunk lid 12 either to swing up into its top pivot position or be moved into its bottom pivot position or locking position. In this bottom pivot position a male element 13 of the trunk lock 13, 14 provided below the rear transverse edge 21 of the lid 12 can engage in a female element 14 of the lock 13, 14 arranged in the area of the upper edge of the rear transverse wall of the trunk 16 and on the inner side thereof. The male element 13 is designed so that it fits perfectly in the recess or hollow of the female element 14. The male and female elements 13, 14 may be of complementary cylindrical form, or alternatively pyramid-or truncated pyramid-shaped or cone- or truncated cone-shaped. All the shapes are suitable for positive interlocking. To facilitate insertion of the male element 13 into the female element 14 it is advantageous if the male element comprises a downwardly tapering cross section of complementary shape in order that the lock 13, 14 may be properly centred, upon the interconnection of the actual lock sections.

A stop pawl 20 is pivotably mounted on the female element 14 as can be seen in detail in FIG. 2, its associated ratchet 22 being capable of disengaging from a recess 24 in the female element 14 in opposition to the action of a retaining spring 23 when the male element 13 moves into the female element 14. When the male element 13 is fully engaged in the female element 14, the pawl 20 drops back into the recess 24 under the action of this retaining spring 23 and also into a recess 26 in the male element 13, positively overlapping the bottom transverse edge 27 of said recess. The trunk lock 13, 14 is then locked and can be unlocked again with a suitable key with which the pawl 20 can be moved at least out of the recess 26 in the male element 13.

A holder 28 designed in the form of a brace or support comprises a round steel tube 29 in which a round steel bar 31 is removably guided. To anchor the steel bar 31 relative to the steel tube 29 there is provided a locking screw 33 which can be screwed into a radially tapped hole 32 in the steel tube 29 and adequately tightened by hand with the aid of a handle 34. A spiral spring 36, concentrically encircling the left-hand lower end section of the tube 29 shown in FIG. 2, is welded by its upper end on the lower end of the steel tube 29 shown in FIG. 1. The spiral spring 36 is designed as a tension spring having coils 37 which directly engage on one another when the spring is in an untensioned state. Welded to the other end of the spiral spring 36 is the same male element 13 which is used as standard on the trunk lock 13, 14 of the motor car 11. The standard-type female element 14 of the trunk lock 13, 14 which bears the pawl 20 is welded to the upper end of the steel bar 31 shown in FIG. 1. The male and female elements 13, 14 of the holder 28 are arranged with orientation suitable for insertion thereof into the complementary parts 13 or 14 of the trunk lock. This orientation can be adjusted at any time by turning the steel bar 31 in the steel tube 29.

If the trunk lid 12 is to be anchored in a predetermined open position, in order that a bulky article 38 may be transported in the trunk 16 without the risk of damage to the article itself or to the lid 12, the holder 28 can be used as follows:

First, a suitable overall length of the holder 28 is selected by drawing the steel bar 31 out of the tube 29 by a predetermined distance and fixed by tightening the set screw 33. The holder 28 with its male element 13 is then introduced into the female element 14 of the trunk lock 13, 14, the pawl 20 of the latter locking the male element 13 of the holder 28. The holder 28 is then swung inwardly until the male element 13 of the trunk lid 12 can engage in the female element 14 of the holder and be locked by the pawl 20. The trunk lid 12 is then secured for example in the position shown in FIG. 1. It may swing upward slightly during travel as a result of the extensibility of the spiral spring 36 so that hard impacts can be resiliently absorbed, but it cannot execute swinging movements of great amplitude since the constant of flexibility of the spiral spring 36 is advantageously relatively great. Its downward pivoting motion is substantially limited by the direct contact of the coils 37 of the spiral spring 36 on one another. The spiral spring, which can also be bent at right angles to its longitudinal axis, may project outwardly somewhat so that even small downward pivoting movements of the trunk lid are still possible, but only to a small extent, particularly since these outward projections of the spiral spring 36 are absorbed and limited by the upper edge section 39 of the rear transverse wall 41 of the trunk 16.

It is understood that the holder 28 can also be secured to the trunk lid 12 and car body 19, 39, 41 in such a way that the female element 14 of the holder 28 is first mounted on the male element 13 on the trunk lid and locked thereon, and only then is the male element 13 of the holder 28 inserted into the female element 14 of the trunk lock 13, 14. However, this type of use is somewhat laborious with the illustrated embodiments on account of the less favourable levering conditions during the inward movement of the holder.

Finally, the tube 29 with its male element 13 engaging in the female element 14 can also be firstly mounted on the rear transverse wall 41 and the steel bar 31 with the female element on the male element 13 on the trunk lid 12, and only then can the two bracing elements 29 and 31 of the holder 28 be inserted in one another and anchored together with the lid 12 in the correct pivot position. It is then particularly simple to select the most advantageous length for the holder. It is also possible to use the holder 28 with a certain degree of pretensioning, i.e. with a slightly extended spiral spring 36, to ensure that the trunk lid always bears with a certain force against the bulky article 38 which is to be transported, and is at the same time retained thereby.

In the illustrated embodiment the steel bar 31 is slightly longer than the hollow space defined by the steel tube 29 and the spiral spring 36 welded thereto. The bar has a diameter of approximately 9 mm, and the internal diameter of the steel tube 31 is greater by the amount of clearance necessary for removing the steel bar 31. The length of the spiral spring 36 is approximately the same as that of the steel tube 29 and is about 10cm. The spiral spring is coiled from a 3 mm spring-steel wire.

The special design of the male and female elements 13 and 14 of the holder 28 is unimportant to the invention per se, but it is important that the standard-type male and female elements of the trunk lock can be used on any type of vehicle.

The spiral spring 36, which on account of its shape is particularly suitable for producing a strong and cheap to produce welded joint to the end of the bar 31, is also frequently referred to as a coil spring in technical usage.

The holder 43 shown in FIG. 3 is intended for motor cars, the trunk lock of which comprises a disc-shaped female element 44, rotatably mounted for example on the trunk lid 12 and having an open-edged slot 46 sloping downwardly in the centre towards the closing direction of the lid 12, in which slot engages a section 48, parallel to the rotating axle 47 of the female element 44, of a male element 49 connected for example to the rear transverse wall 41 of the trunk, when the trunk lid 12 is lowered. The female element 44 in these locks 44, 49 is rotated through a certain angle as a result of this closing movement, the rear edge 51 of the slot 46, as seen in the direction of rotation, engaging positively on the rear of the section 48 parallel to the axle 47, in which position the female element 44 can be locked by means of a locking device such as a catch 52 which drops under spring force into an open-edged recess 53 having a complementary internal cross section of the disc 44.

The slot 46 or opening can have a slightly S-shaped rising form as can be seen in FIG. 5 or even extend radially in a straight line or straight in sections with different slopes; it should only be ensured that the female element 44 can be rotated as far as and into a position to engage the rear of the locking segment 48 of the male element 49.

A U-shaped section 49, suitable for a male element and bent out of a round steel bar 54, can be shaped for example as shown in FIG. 4, with sides 56 and 57 connected at right angles to a straight yoke section 48, and comprising parallel and sections 58 and 59 bent at right angles some distance from the yoke 48, which end sections are welded to a fastening plate 61 with an oblong hold 62 for receiving a fastening screw.

This U-shaped section 49 is arranged on the rear transverse wall 41 of the trunk 16 so that the yoke projects freely inwardly or upwardly in a position suitable for engagement with female element 44 of the holder 43.

The female element 63 which can be connected to the male element 49 of the trunk lock 44, 49 is then designed as a hook 64 which can be suspended from the yoke 48 of the U-shaped section 49 and formed by an unthreaded end of a threaded bar 66 bent in the shape of a semi-circle.

The internal radius of curvature 70 of the hook 64 is at least as great as half the diameter of the thickest yoke 48 of the male element 49 on the trunk lock which is to be suitable for connection to the holder 43.

The threaded bar 66 is screwed into a short threaded section 67 which has an external thread 68 with the same effective diameter and pitch as the internal thread formed by the coils of the spiral spring 36 and is screwed into the free end of the spiral spring 36. The thread 69 for the hook 64 is cut in a blind hole 65 in the threaded section 67.

A knurled nut 71 made of plastic material can be screwed on the threaded bar 66, the side of the said nut facing the hook 64 and the yoke 48 of the male element 49 comprising a rubber coating or lining 72, several millimeters thick, into which the yoke 48 can more slightly when the knurled nut 71 is tightened. There is then formed an, as it were, positive closure of the hook opening 73, and the hook 64 is maintained in direct contact with the yoke 48 under elastic tension.

To connect the holder 43 and the female element 44 of the trunk lock, a standard-type male element 49 of the trunk lock 44, 49 can be welded to the end of the steel bar 31 which can be removed from the steel tube 29. This is possible so that the fastening plate is welded along the end section of the bar so that the sides 56 and 57 connected to the yoke 48 extend at right angles to the axis of the steel bar 31, or even so that the end of the bar 31 is butt-welded to the fastening plate 61 so that the sides 56, 57 adjacent to the yoke 48 run parallel to the axis of the holder 43.

Instead of welding the standard male element 49 on to the bar 31, a short end section 74 of the steel bar 31 can also be bent at right angles as shown in FIG. 3, which end then engages positively in the slot 46 of the female element 44. This end section 74, which represents, as it were, only half of the yoke 48 of a standard-type male element, is provided on its free face with a flange 76 whose diameter is greater than the internal width of the slot 46 so that the right-angled end 74 of the bar 31 cannot spring laterally out of its position of engagement in the female element 44.

It is understood that the hook-shaped female element 63, bearing in mind the necessary design modifications, could also be fastened to the end of the steel bar 31 and the male element 49 to the free end of the spiral spring 36, and that likewise the male element of the trunk lock on the trunk lid 12 and the female element could be rigidly mounted on the car body. The holder 64 would then have to be connected to the parts 44 and 49 of the trunk lock if necessary, in a position rotated through 180°.

In the embodiment of the invention shown is FIGS. 3 to 5 the internal radius of curvature of the hook 64 is 6 mm and the bent end section 74 of the steel bar 31 or the yoke 48 of the standard-type male element 49 has a diameter of 9 mm. The holder 43 can then be used in combination with all trunk locks in which the internal or clear width of the slot 46 of the female element 49 and the diameter of the yoke are between 9 and 12 mm.

What we claim is:

1. A holder for anchoring the trunk lid of a car in a predetermined open position, for a trunk which is lockable by means of a snap-locking trunk lock, a first half of which is arranged on the trunk lid and a second half on a wall of the trunk, comprising a bracing bar which is provided with a tube section and a bar section telescopically, removably inserted in said tube section, and a locking means for anchoring said bar section in drawnout position, said bracing bar being provided at its tube section and at its bar section with first and second fastening members for securing the said holder to the trunk lid and the trunk wall, respectively, at least one of said fastening members of the bracing bar being adjustably mounted with respect to the longitudinal axis of said bracing bar, said fastening members of said bracing bar being arranged at the opposed free ends of the tube section and of the bar section and adapted to positively engage with respective ones of the trunk lock halves, the bracing bar being provided with a flexible end portion to which the one of said fastening members is secured, to permit the positive interconnection of said fastening members with cooperating trunk lock halves.

2. A holder for anchoring the trunk lid of a car in a predetermined open position, for a trunk which is lockable by means of a snap-locking trunk lock a first half of which is arranged on the trunk lid and a second half on a wall of the trunk, comprising a bracing bar which is provided with a tube section and a bar section telescopically, removably inserted in said tube section, and locking means for anchoring said bar section in drawnout position, said bracing bar being provided at its tube section and at its bar section with first and second fastening members for securing the said holder to the trunk lid and the trunk wall, respectively, at least one of said fastening members of the bracing bar being adjustably mounted with respect to the longitudinal axis of said bracing bar, said fastening members of said bracing bar being arranged at the opposed free ends of the tube section and of the bar section and adapted to positively engage with respective one of the trunk lock halves, the bracing bar being provided with articulated means to permit positive interconnection of said fastening members with cooperating trunk lock halves.

3. A holder as claimed in claim 1, wherein the first lock half is a female element, and the second lock half a male element, and wherein said first fastening member is a male element shaped so as to be capable of engaging with the female element, and said second fastening member is a female element shaped so as to be capable of engaging with the male element.

4. A holder as claimed in claim 2, wherein said first fastening member is a standard-type male element and said second fastening member a standard-type female element.

5. A holder as claimed in claim 1 wherein said flexible end portion is in the form of a spiral tension spring which encircles one end of said tube section at one of its ends, one of said fastening members being welded to its other end.

6. A holder as claimed in claim 5, wherein said spiral spring is arranged on the end of said bracing bar bearing the fastening member which can engage with the first lock half of the trunk lock which is rigidly fixed to the car body.

7. A holder as claimed in claim 3, wherein said bracing bar comprises at least two supporting members rigidly connected to select the length of said bracing bar, and wherein male and female elements are each connected to the ends of said bracing bar and are interconnected through a flexible connection having a pivot axis parallel to the pivot axis of the trunk lid.

8. A holder as claimed in claim 1 comprising means for locking the holder in a setting corresponding to the desired opening angle of the trunk lid.

9. A holder, as claimed in claim 1 for a motor car of a type with a trunk lock with a male element in the form of a U-shaped section, and a female element, in the form of a rotatably mounted disc having an open-edged, slot-shaped recess in which the U-section engages when the trunk lid is closed upon rotation of the disc, at least one edge section of the recess engaging positively on the rear of the U-section, in which position the disc can be locked by means of a catch mechanism or the like, wherein the fastening member at the end of the holder to be connected to the U-section comprises a hook which can be suspended from the U-section and is provided with retaining means which can be adjusted to suit U-sections of varying thicknesses, and which maintains said hook in a position of engagement in the U-section, and wherein the fastening member at the other end of the holder has a cross section which is adapted to the narrowest width of recess in the female element used.

10. A holder as claimed in claim 9, wherein a standard U-section of the trunk lock having the smallest material cross section of such type of U-sections is used as a male fastening member of the holder.

11. A holder as claimed in claim 9, wherein said fastening member at the other end of the holder comprises an end section bent at right angles to the longitudinal axis of the holder on a telescopically removable bar in a tube section, the free end of said end section being provided with a flange having a diameter greater than the width of the recess in the disc.

12. A holder as claimed in claim 9, wherein said retaining means comprises a knurled nut which is guided along a threaded section of said hook and is provided with a rubber lining on its side directed towards said hook.

13. A holder as claimed in claim 12, wherein said threaded section of said hook is screwed into a tapped hole in a threaded piece attached to said flexible means comprising a spiral spring on said bracing bar, sand tapped hole being coaxial with said spiral spring.

14. A holder as claimed in claim 13 wherein said threaded piece has an external thread with approximately the same pitch and effective diameter as the internal thread formed by coils of said spiral spring.

* * * * *